US006551978B2

(12) United States Patent
Hanada et al.

(10) Patent No.: US 6,551,978 B2
(45) Date of Patent: Apr. 22, 2003

(54) AZEOTROPIC SOLVENT COMPOSITION AND CLEANING METHOD

(75) Inventors: Tsuyoshi Hanada, Chiba (JP); Masaaki Tsuzaki, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/871,899

(22) Filed: Jun. 4, 2001

(65) Prior Publication Data

US 2002/0006885 A1 Jan. 17, 2002

(30) Foreign Application Priority Data

Jun. 5, 2000 (JP) ..... 2000-167829

(51) Int. Cl.[7] ..... C11D 7/30

(52) U.S. Cl. ..... 510/412; 510/407; 510/408; 510/415

(58) Field of Search ..... 510/407, 408, 510/412, 415

(56) References Cited

U.S. PATENT DOCUMENTS 5,118,438 A * 6/1992 Magid et al.

* cited by examiner

*Primary Examiner*—Gregory E. Webb
(74) *Attorney, Agent, or Firm*—Oblon, Spivak, McClelland, Maier & Neustadt, P.C.

(57) ABSTRACT

An azeotropic solvent composition comprising 90.3 mass % of 1,3-dichloro-1,1,2,2,3-pentafluoropropane and 9.7 mass % of n-hexane.

5 Claims, No Drawings

AZEOTROPIC SOLVENT COMPOSITION AND CLEANING METHOD

BACKGROUND OF THE INVENTION

1. Field of the Invention

The present invention relates to an azeotropic composition and a cleaning method to be used for removing soils such as oils or dusts adhered to articles such as electronic components such as integrated circuits, precision (machinery) components or glass substrates.

2. Discussion of Background

To remove various oils, dusts, etc., 3,3-dichloro-1,1,1,2,2-pentafluoropropane (hereinafter referred to as R225ca), 1,3-dichloro-1,1,2,2,3-pentafluoropropane (hereinafter referred to as R225cb) or a mixture thereof (hereinafter referred to as R225), which is non-flammable, less toxic and excellent in the stability, is, for example, widely used.

However, there are certain soils which can not be removed by R225ca, R225cb and R225 (hereinafter these will generally be referred to as R225s), and the range of their application has been limited.

SUMMARY OF THE INVENTION

It is an object of the present invention to provide a solvent composition which is an azeotropic composition and which can be used in a wider range of applications, by improving the solvency for soils, while maintaining the non-flammability which is a characteristic of R225s.

As a result of an extensive study, the present inventors have found it possible to prepare an azeotropic composition by mixing R225cb and n-hexane in a specific ratio and to improve the solvency to a level higher than R225cb.

The present invention provides an azeotropic solvent composition comprising 90.3 mass % of 1,3-dichloro-1,1,2,2,3-pentafluoropropane and 9.7 mass % of n-hexane.

Further, the present invention provides a cleaning method which comprises removing soils adhered to an article by means of the above azeotropic solvent composition.

DETAILED DESCRIPTION OF THE PREFERRED EMBODIMENTS

The blend compositional ratio of the azeotropic solvent composition comprising R225cb and n-hexane is R225cb/n-hexane=90.3 mass %/9.7 mass %, and the boiling point of this azeotropic composition is 55.1° C. at 1013 hPa.

U.S. Pat. No. 5,118,438 discloses an azeotrope-like composition comprising R225cb/n-hexane=76.5 to 88.5/11.5 to 23.5 (mass %) . The present invention is based on a discovery that an azeotropic composition exists outside the compositional range of such an azeotrope-like composition. The azeotropic solvent composition comprising R225cb and n-hexane of the present invention has an advantage in that as compared with the conventional azeotrope-like composition comprising R225cb and n-hexane, there is no compositional change in the composition even if the composition is subjected to evaporation and condensation repeatedly, and an extremely stable performance can be maintained.

The solvent composition of the present invention is non-flammable and is an azeotropic composition, whereby there is no change in the composition even when it is used for vapor degreasing or repeatedly used by e.g. distillation, and it can be used in the same manner as R225cb, whereby no substantial change of the prior art is required for its use.

The azeotropic solvent composition of the present invention is useful for various applications in the same manner as the conventional R225s compositions. Specific applications include an application as a cleaning agent to remove soils adhered to an article and an application as a carrier solvent for coating various compounds or as an extracting agent. Further, as its solvency is higher than R225s, it can be used for removing soils or as a solvent or an extracting agent, in a range wider than R225s.

The azeotropic solvent composition of the present invention is particularly suitable as a cleaning agent to remove soils adhered to an article. The article to be cleaned may, for example, be made of glass, ceramics, plastic, elastomer or metal. Specifically, the article may, for example, be an electronic or electrical equipment, a precision machinery or equipment, an optical article, or a component of such an article, such as an integrated circuit, a micromotor, a relay, a bearing, an optical lens or a glass substrate.

The soils adhered to the article may, for example, be soils which are used for the manufacture of the article or components constituting the article and which must finally be removed, or soils which are adhered during the use of the article. The substance constituting the soils may, for example, be oils such as greases, mineral oils, waxes or oil-based inks, or dusts.

As a specific means to remove the soils, hand wiping, dipping, spraying, mechanical agitation, combination thereof, may, for example, be employed.

Now, the present invention will be described in further detail with reference to Examples. However, it should be understood that the present invention is by no means restricted to such specific Examples.

EXAMPLE 1

300 g of a mixture comprising R225cb (boiling point: 56.1° C.) and n-hexane (boiling point: 68.7° C.) and having a composition as shown in Table 1, was put into an Osmer gas-liquid equilibrium distillation measuring apparatus, and the temperature when the temperatures of the gas phase and the liquid phase became an equilibrium under 1013 hPa, was measured. Further, a sample of the liquid and gas phases when the temperatures became an equilibrium state, were sampled, and the composition of R225cb and n-hexane was analyzed by gas chromatograph. The results are shown in Table 1.

As a result of the measurements, the mixture was found to constitute an azeotropic composition when R225cb was 90.3 mass %, and n-hexane was 9.7 mass %, and the boiling point (at that time) was 55.1° C. at 1013 hPa.

TABLE 1

| At the time of charging | At the time of gas-liquid equilibrium | | | |
|---|---|---|---|---|
| | Liquid phase | | Gas phase | |
| n-Hexane concentration (mass %) | n-Hexane concentration (mass %) | Temperature (° C.) | n-Hexane concentration (mass %) | Temperature (° C.) |
| 2.0 | 2.0 | 55.7 | 2.3 | 55.8 |
| 5.0 | 5.0 | 55.4 | 5.8 | 55.5 |
| 9.5 | 9.5 | 55.3 | 9.6 | 55.4 |
| 9.7 | 9.7 | 55.1 | 9.7 | 55.1 |
| 10.0 | 10.0 | 55.4 | 9.9 | 55.4 |
| 30.0 | 29.9 | 56.2 | 20.1 | 56.1 |
| 98.0 | 98.3 | 68.6 | 95.5 | 68.2 |

EXAMPLE 2

20 kg of a solvent composition comprising 90.3 mass % of R225cb and 9.7 mass % of n-hexane, was put into a small 15 single sump open top type vapor degreaser, which was then operated for three days by 6 hours per day. The operation conditions were such that only the solvent composition was charged to the cleaning sump, and the recycling amount per hour of the composition until the composition was heated, evaporated, condensed, then led to a water separator and returned to the cleaning sump, corresponded to the amount of the charged composition. As the time passed, sampling was carried out from each of the cleaning sump and the water separator, and the analysis was carried out by gas chromatograph. The results are shown in Table 2.

TABLE 2

| | Composition (mass %) | | | |
|---|---|---|---|---|
| | Cleaning sump | | Water separator | |
| | R225cb | n-hexane | R225cb | n-hexane |
| After 0 hour | 90.3 | 9.7 | 90.3 | 9.7 |
| After 6 hours | 90.3 | 9.7 | 90.3 | 9.7 |
| After 12 hours | 90.3 | 9.7 | 90.3 | 9.7 |
| After 18 hours | 90.3 | 9.7 | 90.3 | 9.7 |

EXAMPLE 3

A cleaning test of a metal processing oil was carried out by using a solvent composition comprising 90.3 mass % of R225cb and 9.7 mass % of n-hexane. Namely, a SUS-304 test coupon (25 mm×30 mm×2 mm) was dipped in a metal processing oil i.e. Temper Oil (manufactured by Nippon Grease K.K.) to adhere the metal processing oil. The test coupon having the metal processing oil adhered, was immersed for 5 minutes in the solvent composition maintained at 40° C. for cleaning. The degree of removal of the metal processing oil (◎: excellently removed, Δ: slightly remained, ×: substantially remained) was evaluated, and the results are shown in Table 3.

EXAMPLE 4 (COMPARATIVE EXAMPLE)

A test was carried out in the same manner as in Example 3 except that the solvent was changed to R225cb only, and the results are shown in Table 3.

TABLE 3

| | Solvent | Composition (mass %) | evaluation |
|---|---|---|---|
| Example 3 | R225cb/n-hexane | 90.3/9.7 | ◎ |
| Example 4 | R225cb | 100.0 | Δ |

EXAMPLE 5

Using a solvent composition comprising 90.3 mass % of R225cb and 9.7 mass % of n-hexane, a flash point was measured by means of a Cleveland open cup tester and a Tag closed cup tester. As a result, it was confirmed there was no flash point by either test method.

As described in the foregoing, the composition of the present invention is a solvent composition comprising R225cb and n-hexane and an azeotropic composition, whereby there is no change in the composition even when it is used for vapor degreasing or repeatedly used by distillation, and the cleaning property or various physical properties will not change. Accordingly, no substantial change of the conventional technique will be required for its use. Further, the solvency of soils is improved while the non-flammability is maintained which is a characteristics of R225s, whereby it has an advantage such that it can be used for a wider range of applications than R225s.

The entire disclosure of Japanese Patent Application No. 2000-167829 filed on Jun. 5, 2000 including specification, claims and summary are incorporated herein by reference in its entirety.

What is claimed is:

1. An azeotropic solvent composition comprising 90.3 mass % of 1,3-dichloro-1,1,2,2,3-pentafluoropropane and 9.7 mass % of n-hexane.

2. A cleaning method which comprises removing soils adhered to an article by means of the composition as defined in claim 1.

3. The cleaning method according to claim 2, wherein the article is made of glass, ceramics, plastic, elastomer or metal.

4. The cleaning method according to claim 2, wherein the article is an electronic or electrical equipment, a precision machinery or equipment, an optical article, or a component thereof.

5. The cleaning method according to claim 2, wherein the substance constituting the soils is oils such as greases, mineral oils, waxes or oil-based inks.

* * * * *